US010060435B2

(12) United States Patent
Wennemar

(10) Patent No.: US 10,060,435 B2
(45) Date of Patent: Aug. 28, 2018

(54) SCREW MACHINE AND METHOD FOR OPERATING THE SAME

(71) Applicant: MAN Diesel & Turbo SE, Augsburg (DE)

(72) Inventor: Jürgen Wennemar, Haltern am See (DE)

(73) Assignee: MAN Energy Solutions SE, Augsburg (DE)

( * ) Notice: Subject to any disclaimer, the term of this patent is extended or adjusted under 35 U.S.C. 154(b) by 29 days.

(21) Appl. No.: 15/181,932

(22) Filed: Jun. 14, 2016

(65) Prior Publication Data

US 2016/0369801 A1 Dec. 22, 2016

(30) Foreign Application Priority Data

Jun. 16, 2015 (DE) ..... 10 2015 007 552

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 29/00*** | (2006.01) |
| ***F04C 18/16*** | (2006.01) |
| ***F04C 28/28*** | (2006.01) |
| ***F04C 29/02*** | (2006.01) |
| *F04C 29/04* | (2006.01) |

(Continued)

(52) U.S. Cl.

CPC ..... *F04C 29/0014* (2013.01); *F04C 18/16* (2013.01); *F04C 28/28* (2013.01); *F04C 29/021* (2013.01); *F04C 27/004* (2013.01); *F04C 28/24* (2013.01); *F04C 29/042* (2013.01); *F04C 2240/81* (2013.01); *F04C 2270/215* (2013.01)

(58) Field of Classification Search

CPC ..... F04C 29/021; F04C 29/042; F04C 18/16; F04C 28/28; F04C 28/24; F04C 27/004; F04C 2240/81; F04C 2270/215

USPC ..... 418/1, 84, 97–99, 201.1–201.3

See application file for complete search history.

(56) References Cited

U.S. PATENT DOCUMENTS

| | | | | |
|---|---|---|---|---|
| 9,568,001 | B2 | 2/2017 | Endo et al. | |
| 2012/0247139 | A1* | 10/2012 | Yonemoto | F04C 18/16 418/201.1 |

FOREIGN PATENT DOCUMENTS

| | | |
|---|---|---|
| DE | 3022202 | 8/1982 |
| DE | 3803044 | 8/1989 |
| WO | WO 2014/041680 | 3/2014 |

OTHER PUBLICATIONS

Search Report dated Dec. 12, 2016 which issued in the corresponding Great Britain Patent Application No. 1610251.9.

* cited by examiner

*Primary Examiner* — Theresa Trieu
(74) *Attorney, Agent, or Firm* — Cozen O'Connor

(57) ABSTRACT

A screw machine, in particular screw compressor, includes a machine housing, screw rotors forming a rotor pair which is mounted in the machine housing, an oil supply system via which bearings and seals of the screw rotors can be supplied with oil for lubricating and/or cooling, wherein the oil supply system has an oil supply and oil feeds, wherein the oil supply system includes a pressure sensor, which detects a pressure in the oil discharge or oil return or a pressure difference between the pressure in the oil discharge or oil return and a pressure in the oil feeds, the oil supply system furthermore includes a control device, which open-loop or (Continued)

closed-loop controls the pressure in the oil feed or the pressure difference dependent on the measurement signal of the pressure sensor.

10 Claims, 1 Drawing Sheet

(51) Int. Cl.
*F04C 27/00* (2006.01)
*F04C 28/24* (2006.01)

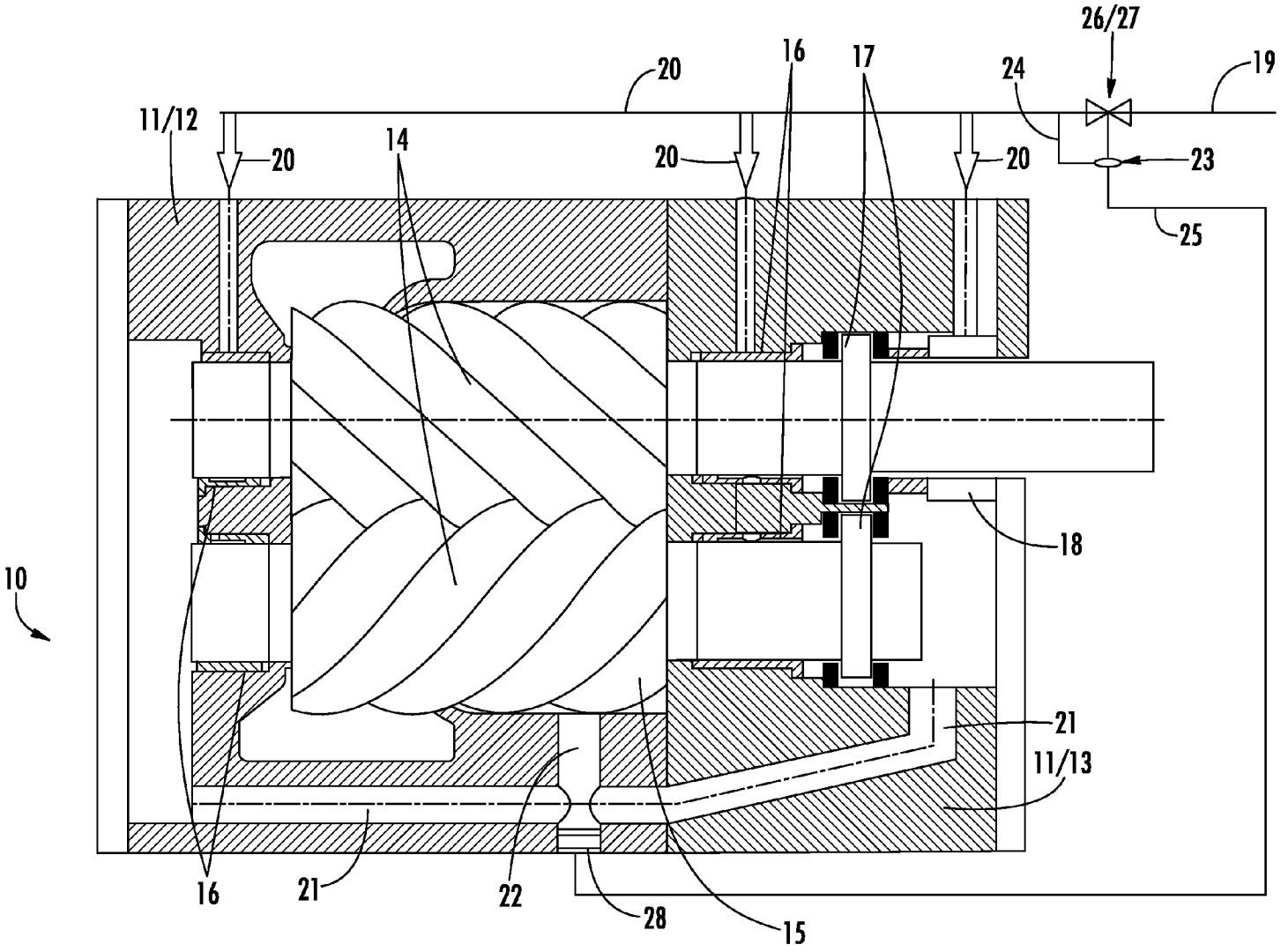
19
26/27
23
25
24
20
20
20
20
17
16
18
21
11/13
15
28
22
14
21
16
11/12
10

SCREW MACHINE AND METHOD FOR OPERATING THE SAME

1. FIELD OF THE INVENTION

The invention relates to a screw machine, in particular a screw compressor. The invention furthermore relates to a method for operating a screw machine, in particular a screw compressor.

2. BACKGROUND OF THE INVENTION

The fundamental construction of screw machines designed for example as screw compressors is known to the person skilled in the art addressed here. Accordingly, a screw compressor comprises a machine housing or a compressor housing, which comprises a first housing section and a second housing section. In the first housing section, screw rotors are mounted which form a rotor pair and serve for compressing a medium to be compressed. Likewise, a control slide valve is typically mounted in the first housing section, which in sections delimits a working space or a compression space of the first housing section and for changing the size of the effective working space or effective compression space can be shifted parallel to the rotor axes of the screw rotors.

From DE 30 22 202 C2 and from DE 38 03 044 A1, the content of which is incorporated herein in their entirety, the fundamental construction of screw machines designed for example as screw compressors is known. Accordingly, a screw compressor comprises a machine housing or a compressor housing, wherein in the machine housing or compressor housing screw rotors are mounted which form a rotor pair. The screw rotors of the screw compressor in this case are mounted in the machine housing via axial bearings and radial bearings. Seals assume the sealing of the screw rotors, in particular the sealing of shaft passages of the screw rotors in the machine housing.

It is known, furthermore, to supply the bearings and seals of the screw rotors of such a screw machine with oil starting out from an oil supply system in order to lubricate and/or cool the bearings and seals of the screw rotors. To this end, the oil supply system of the screw machine comprises an oil feed in order to feed the oil to the bearings and seals to be lubricated and/or cooled and comprises an oil discharge or oil return in order to subsequently discharge the oil from the bearings and seals.

In the case of so-called oil-injected screw compressors, the oil, which is discharged from the bearings and seals via the oil discharge or oil return is conducted in the direction of the compression space of the screw compressor starting out from the oil discharge via an oil feed, which is also called feed location here, wherein the oil in the compression space mixes with the working medium, in particular with a gas to be compressed and is then pushed out from the screw machine.

The oil feed or the feed location, via which the oil discharged from the bearings and seals can be conducted in the direction of the compression space of the screw compressor, is located, in many screw compressors, seen in delivery direction behind a termination of the compression chamber towards the suction side of the screw compressor. In the oil discharge or oil return or the oil feed, a pressure is present the knowledge of which is necessary in order to supply the bearings and seals of the screw machine with an adequate quantity of oil for cooling and/or lubricating. Accordingly, it is provided with screw machines known from practice to determine the pressure in the oil discharge or oil return or the pressure in the oil feed branching off the oil discharge or oil return through calculation, in order to dependent on this build up an adequately high pressure difference on the bearings and/or seals to be cooled and/or lubricated in order to ultimately supply the bearings and seals with an adequate quantity of oil for cooling and/or lubricating.

The determination through calculation of the pressure in the region of the oil discharge or oil return or oil feed is inaccurate and can greatly fluctuate with changing suction pressure of the screw machine. Furthermore, this pressure is dependent on a so-called isentropic exponent of the working medium, in particular of a gas to be compressed. The position of a control slide valve of the screw machine that may be present can also affect this pressure. Since the determination by calculation of the pressure in the oil discharge or oil return or oil feed accordingly is inaccurate and can be subject to great fluctuations, the pressure determined by calculation is always offset by a high safety allowance in the case of screw machines known from practice, in order to always ensure a secure oil supply of the bearings and seals. Here, the appropriate pressure for the bearings and for the seals in screw machines known from practice is adjusted in each case via separate pressure controllers.

The disadvantages of such screw machines known from practice consists in that too much oil is conducted in the direction of the bearings and seals because of the determination of the pressure in the oil discharge or oil return or oil feed which is only relatively inaccurate and of the relatively high safety allowance or offset. In the case that the suction pressure of the screw machine rises unexpectedly high, a secure oil supply of the bearings and seals can no longer be ensured when a minimum pressure difference is undershot. Because of this, the bearings and seals can be damaged and impaired in their function. There is therefore a need for a screw machine and a method for operating the same, with the help of which the disadvantages known from practice can be avoided. Starting out from this, the invention is based on the object of creating a new type of screw machine and a method for operating the same.

SUMMARY OF THE INVENTION

According to the invention, the oil supply system comprises a pressure sensor which detects a pressure in the oil discharge or oil return or a pressure difference between the pressure in the oil discharge or oil return and a pressure in the oil feed or feeds. The oil supply system furthermore comprises a control device, which open-loop or closed-loop controls the pressure in the oil feed(s) or the pressure difference that is dependent thereon on the measurement signal of the pressure sensor.

According to the invention, the pressure in the oil discharge or oil return is not determined by calculation in the case of the screw machine. The pressure in the oil discharge or oil return or a pressure difference that is dependent thereon is rather detected with the help of a pressure sensor. A control device of the oil supply system open-loop or closed-loop controls, dependent on the measurement signal of the pressure sensor, the pressure in the oil feed(s) or a pressure difference that is dependent thereon, so that the bearings and shafts of the screw machine can always be supplied with an oil pressure or an oil pressure difference which in all operating states, even with suction pressures rising high, ensures a reliable oil supply of the bearings and shafts. Optimal oil supply of the bearings and shafts is always ensured.

According to an advantageous further development, the oil supply system of the screw machine according to the invention for the bearings and seals of the screw rotors comprises a common oil supply and a common oil discharge or oil return, wherein preferentially the discharged or returned oil, starting out from the oil discharge or oil return, can be fed to a working space of the screw machine via an oil back feed branching off the oil discharge or oil return. The pressure sensor detects the pressure in the common oil discharge or oil return, preferentially in the oil back feed, or the pressure difference that is dependent thereon. Dependent on the measured pressure or the measured pressure difference, the control device open-loop or closed-loop controls a common oil feed-side pressure or the pressure difference that is dependent thereon for the bearings and the seals of the screw rotors.

This configuration is particularly advantageous. The open-loop or closed-loop control of the oil feed-side pressure or of the pressure difference that is dependent thereon is effected jointly for bearings and seals of the screw rotors. With a single valve and associated controller, a pressure on the oil feed-side that is always optimal for the oil supply of the same or the pressure difference that is dependent thereon can be automatically provided.

According to an advantageous further development, the pressure sensor detects an actual pressure difference between the pressure in the common oil feed and the pressure in the common oil discharge or oil return, in particular in the oil back feed, wherein the control device, dependent on a deviation between the actual pressure difference and a set point pressure difference, generates a control input for a valve in the oil supply in order to closed-loop control the actual pressure difference to the set point pressure difference via the valve. This configuration is particularly simple and allows a reliable adjustment of a set point pressure difference which under all operating conditions ensures an optimal oil supply of the bearings and the seals of the screw rotors of the screw machine according to the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claim. It should be further understood that the drawings are not necessarily drawn to scale and that, unless otherwise indicated, they are merely intended to conceptually illustrate the structures and procedures described herein.

BRIEF DESCRIPTION OF THE DRAWING

Exemplary embodiments of the invention are explained in more detail with the help of the drawing FIGURE which shows a schematic representation of a screw machine according to the invention.

DETAILED DESCRIPTION OF THE PRESENTLY PREFERRED EMBODIMENTS

In the following, the invention is described making reference to the FIGURE on the example of a screw machine designed as a screw compressor. Although the application of the invention is preferred with screw compressors, the invention could also be employed with other screw machines.

The FIGURE schematically shows a screw machine designed as an oil-injected screw compressor, which screw machine comprises a machine housing designed as a compressor housing 11. Of the compressor housing 11, a first housing section 12 and a second housing section 13 are shown.

The screw compressor furthermore comprises screw rotors 14, which are rotatably mounted in the compressor housing 11 of the screw compressor and form a pair of screw rotors 14. The first housing section 12 of the compressor housing 11 in this case defines a working space or compression space 15 of the screw compressor, in which a medium to be compressed, in particular a process gas or a refrigerant, is compressed. Here, the screw compressor can comprise a control slide valve which is not shown, which dependent on its position defines the size of the effective work space or compression space.

The screw rotors 14 of the screw compressor are mounted in the housing 11 via bearings, namely in the shown exemplary embodiment via radial bearings 16 and axial bearings 17. Furthermore, the FIGURE shows a seal 18, which serves for sealing a shaft passage of one of the screw rotors 14 in the machine housing or compression housing 11.

The bearings 16, 17 as well as the seal 18 of the screw machine designed as screw compressor shown in the FIGURE can be supplied with oil via an oil supply system for lubricating and/or cooling. Accordingly, the FIGURE shows that the screw machine designed as screw compressor comprises an oil supply system, which comprises a common oil supply 19 which is common for the bearings 16, 17 to be lubricated and/or to be cooled and for the seals 18 to be lubricated and/or to be cooled, wherein starting out from this common oil supply 19 the bearings 16, 17 as well as seals 18 can be supplied with oil. The arrows on the oil feeds 20 of the FIGURE illustrate that all bearings 16, 17 and seals 18 of the screw rotors 14 can be supplied with oil starting out from the common oil supply 19.

Oil, which is fed to the bearings 16, 17 and seals 18 for lubricating and/or cooling is discharged from the same via an oil discharge or oil return 21, wherein the screw machine designed as screw compressor comprises a common oil return 21 which is common for all bearings 16, 17 and seals 18 of the screw rotors 14. The oil flowing out from the bearings 16, 17 and seals 18 is collected in the common oil return 21 and fed into the working space or compression space 15 via an oil back feed 22, which branches off the common oil return 21. Here, the compression space 15 is closed off at the location of the oil back feed 22 towards the suction side of the screw compressor so that the sucked-in quantity of working medium, in particular the sucked-in quantity of gas or refrigerant, is not reduced by the fed-in oil or delivery medium sucked in from the oil. Accordingly, the pressure in the compression space 15 at the location of the oil back feed 22 is higher than the suction pressure.

The present invention now relates to such details with the help of which in all operating conditions, even with suction pressures rising high, a reliable oil supply of the bearings 16, 17 and seals 18 to be cooled and/or lubricated with oil can be ensured.

According to the invention, the oil supply system of the screw machine designed as screw compressor in the shown exemplary embodiment comprises a pressure sensor 23, which detects a pressure in the oil discharge or oil return 21 or a pressure in the oil back feed 22 or a pressure difference that is dependent thereon between the pressure in the oil return 21 or the oil back feed 22 and a pressure in the oil feeds 20. In the shown preferred exemplary embodiment, the pressure sensor 23 detects an actual pressure difference between the pressure in the oil feeds 20 that is common for the bearings 16, 17 and the seals 18 and a pressure in the oil return 21 that is common for the bearings 16, 17 and the seals 18, wherein for this purpose the pressure sensor 23 in the shown exemplary embodiment acts with a first pressure measurement line 24 on the oil feeds 20 and with a second pressure measurement line 25 on the oil return 21. The first pressure measurement line 24 acts on the oil feeds 20 downstream of a valve 26. The second pressure measurement line 25 acts on the oil return 21, namely in the region of the oil back feed 22 branching off the oil return 21, via which the oil collected in the common oil return 21 can be conducted into the compression space 15.

The oil supply system of the screw machine designed as screw compressor in the shown exemplary embodiment furthermore comprises a control device 27, which dependent on the measurement signal of the pressure sensor 23 open-loop or closed-loop controls the pressure in the oil feeds 20 or the pressure difference that is dependent thereon. In the shown exemplary embodiment of the FIGURE, the control device 27 closed-loop controls the actual pressure difference between the pressures which are present at the pressure measurement lines 24 and 25 in such a manner that this actual pressure difference is closed-loop controlled to a set point pressure difference.

Here, the control device 27 in the shown exemplary embodiment is an integral assembly of the valve 26. The same can also be embodied as a separate assembly.

Accordingly, a pressure in the oil return 21 or a pressure in the oil back feed 22 branching off the oil return 21 or a pressure difference that is dependent thereon between the pressure in the oil return 21 or the pressure in the oil back feed 22 and a pressure in the oil feeds 20 accordingly is detected by measurement, wherein dependent on the measured pressure or the measured pressure difference the pressure in the oil feeds 20 or the pressure difference is controlled or closed-loop controlled.

Through such an automatic closed-loop control of the pressure in the oil supply 19 or the pressure difference between the pressure in the oil supply 19 and the pressure in the oil return 21 or oil back feed 22, an adequate oil supply of the bearings 16, 17 and seals 18 of the screw rotors 14 to be cooled and/or to be lubricated can always be ensured under all operating conditions, even with suction pressures rising high.

According to the FIGURE, a bore 28 is introduced into the first housing section 12 of the machine housing 11 in the region of the oil back feed 22 branching off the oil return 21, on which the pressure sensor 23 in the shown exemplary embodiment acts with the pressure measurement line 25.

The valve 26 preferentially is a differential pressure control valve, via which in the exemplary embodiment of the FIGURE the differential pressure between the pressures in the measurement lines 24, 25 can be closed-loop controlled to a set point pressure difference.

As already mentioned, all bearings 16, 17 and seals 18 of the screw rotors 14 can be automatically supplied with an optimum oil differential pressure in order to ensure optimal lubrication and/or cooling of the bearings 16, 17 and seals under all operating conditions.

As already explained above, the closed-loop control of the oil supply pressure or of the oil pressure difference for the bearings 16, 17 and the seals 18 takes place jointly. A single valve 26 is adequate for this purpose. It is not necessary to provide separate valves and controllers for the oil pressure supply of the bearings 16, 17 and for the oil pressure supply of the seals 18.

The screw machine according to the invention or the method according to the invention for operating a screw machine make possible reliable oil lubrication and/or oil cooling of the bearings and seals of a screw machine even when the same is operated with fluctuating suction pressures. Through the automatic closed-loop control or control, influences of changing process pressures or suction pressures on the oil supply of the bearing and seals can be automatically offset.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claim appended hereto.

What is claimed:

1. A screw machine (10), comprising:

a machine housing (11);

a pair of screw rotors (14) mounted in the machine housing (11) and having bearings (16, 17) and seals (18);

an oil supply system for supplying the bearings (16, 17) and seals (18) of the screw rotors (14) with oil for at least one of lubricating and cooling; the oil supply system comprising an oil supply (19), oil feeds (20) and an oil return (21), the oil feeds (20) and oil return (21) being common to all bearings (16, 17) and seals (18); the oil supply system further comprising a single pressure sensor (23) for detecting a pressure in the common oil return (21) or a pressure difference between a pressure in the common oil return (21) and a pressure in the oil feeds (20) and for generating a measurement signal;

the oil supply system furthermore comprising a single valve (26) and associated control device (27) disposed in the oil supply (19) for open-loop or closed-loop controlling at least one of the pressure in the common oil feeds (20) and the pressure difference dependent on the measurement signal of the single pressure sensor (23).

2. The screw machine according to claim 1, additionally comprising an oil back feed (22) branching off the oil return (21) for feeding the oil, starting out from the oil return (21), to a working space (15) of the screw machine; and wherein the pressure sensor (23) is constructed to detect at least one of the pressure in the oil back (22) and the pressure difference that is dependent on the pressure in the oil back feed (22).

3. The screw machine according to claim 2, wherein the pressure sensor (23) is constructed to detect an actual pressure difference between a pressure in the common oil feeds (20) and a pressure in the common oil return (21), and wherein the control device (27) is constructed, dependent on a deviation between the actual pressure difference and a set point pressure difference, to generate a control input for the valve (26) in the oil supply (19) in order to closed-loop control the actual pressure difference to a set point pressure difference via the valve (26).

4. The screw machine according to claim 1, wherein the pressure sensor (23) is constructed to detect an actual pressure difference between a pressure in the common oil feeds (20) and a pressure in the common oil return (21); and wherein the control device (27) is constructed, dependent on a deviation between the actual pressure difference and a set point pressure difference, to generate a control input for the valve (26) in the oil supply (19) in order to closed-loop control the actual pressure difference to a set point pressure difference via the valve (26).

5. The screw machine of claim 4, wherein the common oil return (21) is connected to an oil back feed (22) and wherein the actual pressure difference is detected between the pressure in the common oil feeds (20) and a pressure in the oil back feed (22).

6. The screw machine according to claim 4, wherein an actual pressure difference between of the pressure in the common oil return (21) and the pressure in the common oil feeds (20) is detected, and wherein the actual pressure difference is close-loop controlled to a set point pressure difference.

7. The screw machine of claim 1, wherein the screw machine is a screw compressor.

8. A method of operating a screw machine which includes a machine housing (11), screw rotors (14) forming a rotor pair which are mounted in the machine housing (11), and an oil supply system, via which bearings (16, 17) and seals (18) of the screw rotors (14) are supplied with oil for at least one of lubricating and cooling, wherein the oil supply system for the bearings (16, 17) to be at least one of lubricated and cooled and the seals (18) to be at least one of lubricated and cooled comprises an oil supply (19), oil feeds (20) and an oil return (21), the oil feeds (20) and the oil return (21) being common to all bearings (16, 17) and seals (18), and the oil supply system comprising a single valve (26) and associated control device (27); the method comprising the steps of:

measuring with a single pressure sensor at least one of a pressure in the common oil return (21) and a pressure difference between the pressure in the common oil return (21) and a pressure in the common oil feeds (20); and controlling or closed-loop controlling with the single valve and associated control device at least one of the pressure in the common oil feeds (20) and the pressure difference dependent on the measured pressure or on the measured pressure difference.

9. The method according to claim 8, wherein an actual pressure difference between the pressure in the common oil return (21) and the pressure in the common oil feeds (20) is detected, and wherein the actual pressure difference is close-loop controlled to a set point pressure difference.

10. The method of claim 8, wherein the screw machine is a screw compressor.

* * * * *